United States Patent [19]

Soma

[11] 4,365,114

[45] Dec. 21, 1982

[54] AUTOMOTIVE LOUDSPEAKER HAVING VARIABLE SPEAKER ORIENTATION AND PARTICULAR ELECTRICAL CONNECTIONS

[75] Inventor: Hiroshi Soma, Tokyo, Japan

[73] Assignee: Pioneer Electronic Corporation, Tokyo, Japan

[21] Appl. No.: 186,792

[22] Filed: Sep. 12, 1980

[30] Foreign Application Priority Data

Sep. 14, 1979 [JP] Japan ..... 54/127712[U]
Sep. 14, 1979 [JP] Japan ..... 54/127713[U]
Sep. 14, 1979 [JP] Japan ..... 54/127714[U]

[51] Int. Cl.[3] ..... H04R 1/02; H04R 1/20

[52] U.S. Cl. ..... 179/1 VE; 179/1 E; 179/115.5 PS; 181/144

[58] Field of Search ..... 179/1 E, 1 GA, 1 VE, 179/115.5 PS, 116; 181/144, 145, 146, 147, 199

[56] References Cited

U.S. PATENT DOCUMENTS 2,857,478 10/1958 Harris ..... 179/116
3,754,618 8/1973 Sasaki ..... 179/1 GA
4,182,429 1/1980 Senzaki ..... 181/144

*Primary Examiner*—George G. Stellar
*Attorney, Agent, or Firm*—Sughrue, Mion, Zinn, Macpeak & Seas

[57] ABSTRACT

A composite speaker system for automotive vehicles in which a low-range speaker unit is mounted flush with a rear parcel shelf of the vehicle and a medium- and high-range speaker is mounted above the low-range speaker having an angular orientation which is adjustable in a vertical plane with respect to the center axis of the low-range speaker wherein the medium- and high-range speaker can be directed into the passenger compartment without reflection from the rear window. In one embodiment, the medium- and high-range speaker is rotatably mounted upon a grill frame which is detachably disposed upon and engaged with the open surface of the low-range speaker. In a second embodiment, first and second spacers extend from the center of the low-range speaker through the grill frame for the low-range speaker. In this case, the medium- and high-range speaker is tiltably mounted upon the upper end of the spacers. The medium- and high-range speaker may also be made horizontally rotatable.

10 Claims, 6 Drawing Figures

AUTOMOTIVE LOUDSPEAKER HAVING VARIABLE SPEAKER ORIENTATION AND PARTICULAR ELECTRICAL CONNECTIONS

BACKGROUND OF THE INVENTION

The invention relates to a composite speaker system, and more particularly to a composite speaker system of the type in which a low-range speaker unit is mounted flush with a rear parcel shelf of an automotive vehicle so that the open surface of the low-range speaker unit is directed upward.

If a conventional coaxial type composite speaker system, for example, a tri-axial speaker, is used in an automotive vehicle and is flush mounted on the rear parcel shelf, low-range, medium-range and high-range sounds emanating from the speaker system are reflected by the inside surface of the rear window of the vehicle. This type of conventional composite speaker is advantageous in that high fidelity low-range sound is well reproduced since the trunk serves as a cabinet for the speaker system and the space defined by the rear parcel shelf and the rear window serves as a horn. It is, however, disadvantageous in that sound waves of the medium-range and high-range sounds, which are the more important components for creating a stereophonic effect, are attenuated as a result of being reflected by the rear window.

This can be seen from the graph of FIG. 1 which indicates frequency versus sound pressure characteristic curves of a composite speaker system flush mounted on the rear parcel shelf of an automotive vehicle. The solid line I is a sound pressure characteristic curve of the medium-range and high-range sounds in the case of no reflection on the rear glass while the dotted line II illustrates the case of reflection. The conventional system is further disadvantageous in that the position of the sound image is not definite.

SUMMARY OF THE INVENTION

An object of the invention is to provide a composite speaker system for automotive vehicles in which a low-range speaker unit is flush mounted on a rear parcel shelf of the automotive vehicle while a medium- and high-range speaker unit is mounted above the low-range speaker unit and is freely rotatable in a horizontal direction.

This, as well as other objects of the invention, is met by a speaker for automotive vehicles including a low-range speaker and a medium- and high-range speaker with the angular orientation of the center axis of the medium- and high-range speaker being changable in a vertical plane with respect to the center of the low-range speaker. A grill frame and a grill member mounted in the grill frame are disposed over the open surface of the low-range speaker. The grill frame is detachably engaged along the outer periphery of the low-range speaker.

Preferably, the medium- and high-range speaker is mounted upon the grill frame. The grill frame includes an outer annular ring, a center hub portion and a plurality of spokes extending between the outer annular ring and the hub portion with the medium- and high-range speaker being coupled to the hub portion. In this embodiment, a first pair of terminals is mounted upon an outer peripheral portion of a frame member of the low-range speaker and a second pair of terminals is rigidly secured to the grill frame. The first and second pairs of terminals are adapted to be connected together when the grill frame is engaged with the open surface of the low-range speaker. The first pair of terminals is coupled to a voice coil of the low-range speaker while the second pair of terminals is coupled to a voice coil of the medium- and high-range speaker. The first pair of terminals includes an insulating tubular member extending through the frame member and electrically conductive members extending at least partially into the tubular members. The medium- and high-range speaker may be either a single speaker or separate medium-range and high-range speakers can be provided. The medium- and high-range speaker may be horizontally rotatable at least through a predetermined angle.

In another embodiment, a first spacer having a smaller-diameter portion and a larger-diameter portion is coupled with the larger-diameter portion rigidly secured to a frame of the low-range speaker with the larger-diameter portion being at least partially surrounded by the voice coil of the low-range speaker. A damper member has an outer edge coupled to a cone of the low-range speaker and an inner edge coupled to the junction between the larger-diameter portion and the smaller-diameter portion of the first spacer. The smaller-diameter portion has an upper surface which is at least partially tapered. First and second conductors extend through portions of the smaller-diameter portion and form contacts upon the upper surface of the smaller-diameter portion. A second spacer is provided having a lower cylindrical portion tapered to fittingly engage with the upper surface of the first spacer. Third and fourth conductors extend through a portion of the second spacer and form contacts disposed to mate with the contacts formed by the first and second conductors. Means is provided for tiltably mounting the medium- and high-range speaker upon an upper portion of the second spacer. A voice coil of the medium- and high-range speaker is coupled to the third and fourth conductors. The second spacer may be provided with the first guide pin extending downwardly, such as from the center thereof, to mate with a corresponding guide hole formed in the first spacer. Also, a second guide pin rigidly coupled to the second spacer can be provided at an off center position with the second guide pin being slidably disposed in an arc-shaped guide groove coaxially formed in the upper surface of the first spacer.

DESCRIPTION OF THE PREFERRED EMBODIMENTS

A first preferred embodiment of the invention will be described in detail with reference to the accompanying drawings.

Figure 1:
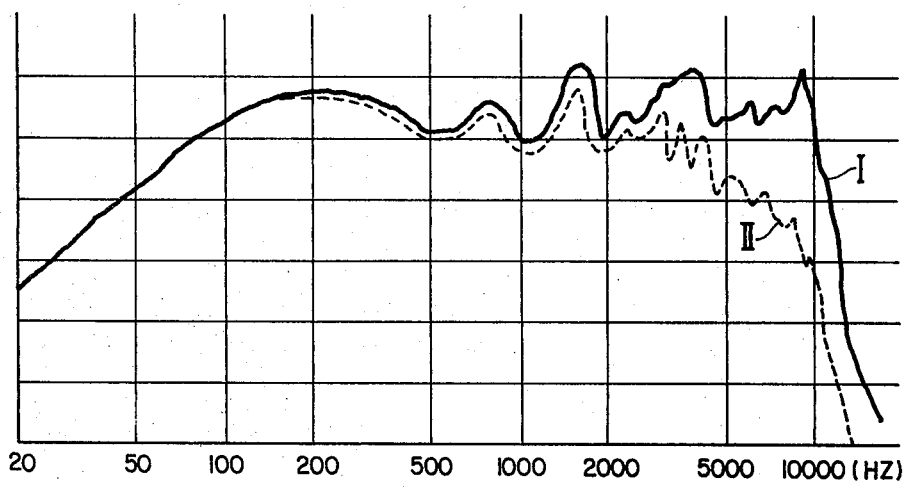
FIG. 1 is a graph showing frequency versus sound pressure characteristic curves of a composite speaker system.
Figure 2:
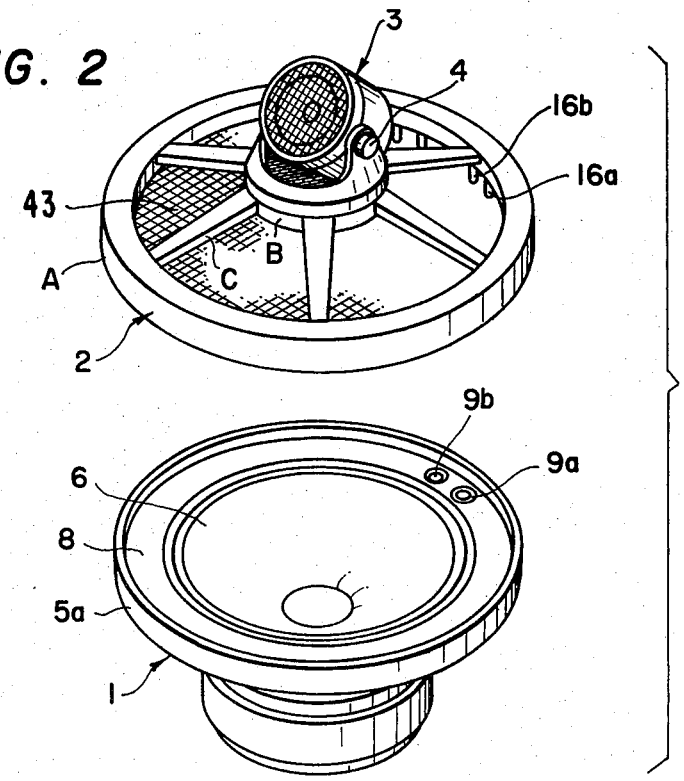
FIG. 2 is an exploded perspective view showing a composite speaker system constructed according to a first embodiment of the invention.

FIG. 2 is an exploded perspective view showing a composite speaker system constructed according to the invention in which reference numeral 1 designates a speaker unit for reproducing low-range sound and 2 an attachment member made of metal or plastic material which is attachable to and detachable from an outer peripheral portion 5*a* of a frame member 5 (shown in FIG. 3) for the speaker unit 1. The attachment member 2 is provided for the purpose of protecting the open surface of the speaker unit 1 and also for purpose of enhancing the appearance of the unit. The attachment member 2 includes an annular ring portion A, a hub portion B and spokes C which radially extend from the hub portion B to the inside wall of the annular ring portion A. A metal grill 43, only a part of which is shown in FIG. 2, extends over the surface of the attachment member 2. Reference numeral 3 designates a speaker unit for reproducing medium- and high-range sound which is mounted in a casing. The speaker unit 3 is coupled to the hub portion B of the attachment member 2.

The speaker units 1 and 3 are arranged so that their sound radiating directions are different. For example, the speaker unit 3 may be arranged so that its sound radiating direction is perpendicular to that of the speaker unit 1. The sound radiating direction of the speaker unit 3 may be varied in the vertical direction by adjustment of a knob 4. Specifically, upon loosening the knob 4, the speaker unit 3 can be rotated about the knob 4 whereas by tightening the knob 4, the speaker unit 3 can be secured at any possible position thereof. It is of course possible to employ another type of adjusting device for vertically adjusting the speaker unit 3.

Figure 3:
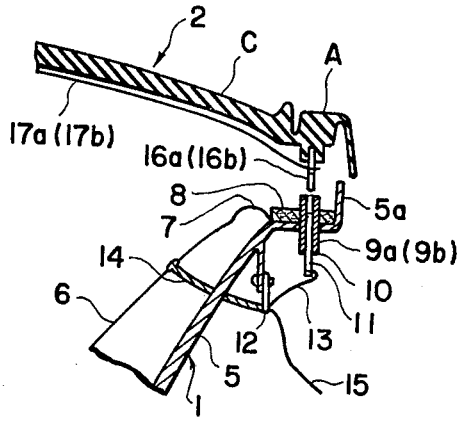
FIG. 3 is a partial cross-sectional view of the speaker system shown in FIG. 2.

Referring to FIG. 3, which is a partial sectional view of the speaker system shown in FIG. 2, an edge portion 7, which acts as a suspension for a diaphragm 6, is fixed to the outer peripheral portion 5*a* of the frame member 5 with a packing 8. A pair of female terminals 9*a* and 9*b* is provided in the packing 8 which pass through the outer peripheral portion 5*a* of the frame member 5. The female terminals 9*a* and 9*b* include a terminal member 11 made of conductive material extending partially into a tubular member 10 made of insulating material. A lead wire 13 with one end connected to a repeater terminal 12 is connected at the other end to the terminal member 11. Reference numeral 14 designates a wire connected between the repeater terminal 12 and the diaphragm 6, and 15 a lead wire connected at one end to the repeater terminal 12 and at the other end to a speaker terminal provided in an amplifier (not shown).

Corresponding to the pair of female terminals 9*a* and 9*b*, a pair of male terminals 16*a* and 16*b* is mounted on the back portion of the annular ring portion A. It is necessary that the male terminals 16*a* and 16*b* be electrically insulated from the annular ring portion A. Electrical insulation can be omitted if the attachment member 2 is made of insulating material such as plastic. Connected to the male terminals 16*a* and 16*b* are lead wires 17*a* and 17*b* which are coupled at their other ends to a network (not shown) located in the interior of the casing of the speaker unit 3.

In the above-described embodiment, while the female terminals 9*a* and 9*b* are mounted on the frame member 5 and the male terminals 16*a* and 16*b* are mounted on the attachment member 2, it is of course possible to mount the female terminals and the male terminals in the opposite positions. It is further possible to employ terminals 9*a*, 9*b*, 16*a* and 16*b* of different configurations from those described above insofar as the same function is achieved.

It is possible to make the medium- and high-range speaker unit 3 rotatable to vary the angle of its center axis in a vertical plane with respect to the center axis of the low-range speaker. Examples of such a structure will be described. In a first example, the speaker unit 3 is mounted on the hub portion B so as not to move about a vertical axis, and the relative position of the attachment member 2 with respect to the open surface of the speaker unit 1 can be easily changed. To this end, plural pairs of male terminals 16*a* and 16*b* are provided along the annular portion A at predetermined intervals so that a single pair of female terminals 9*a* and 9*b* on the outer peripheral portion 5*a* can engage with either one of a pair of the male terminals 16*a* and 16*b*. Plural pairs of lead wires are also provided at the edge portion of the annular ring portion A connected in parallel with one another. In this example, the change of the relative position of the speaker unit 3 in the horizontal plane is carried out in steps.

Figure 6:
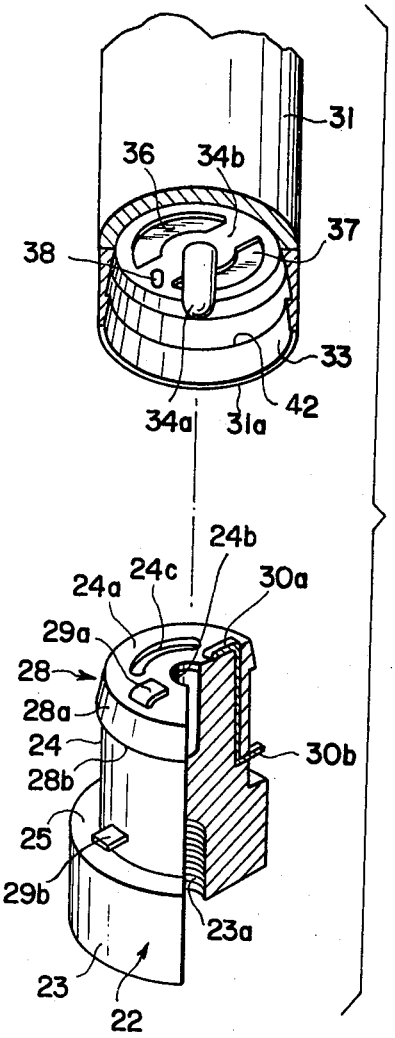
FIG. 6 is an exploded and partial cross-sectional view showing a part of the modification shown in FIG. 5.
Figure 5:
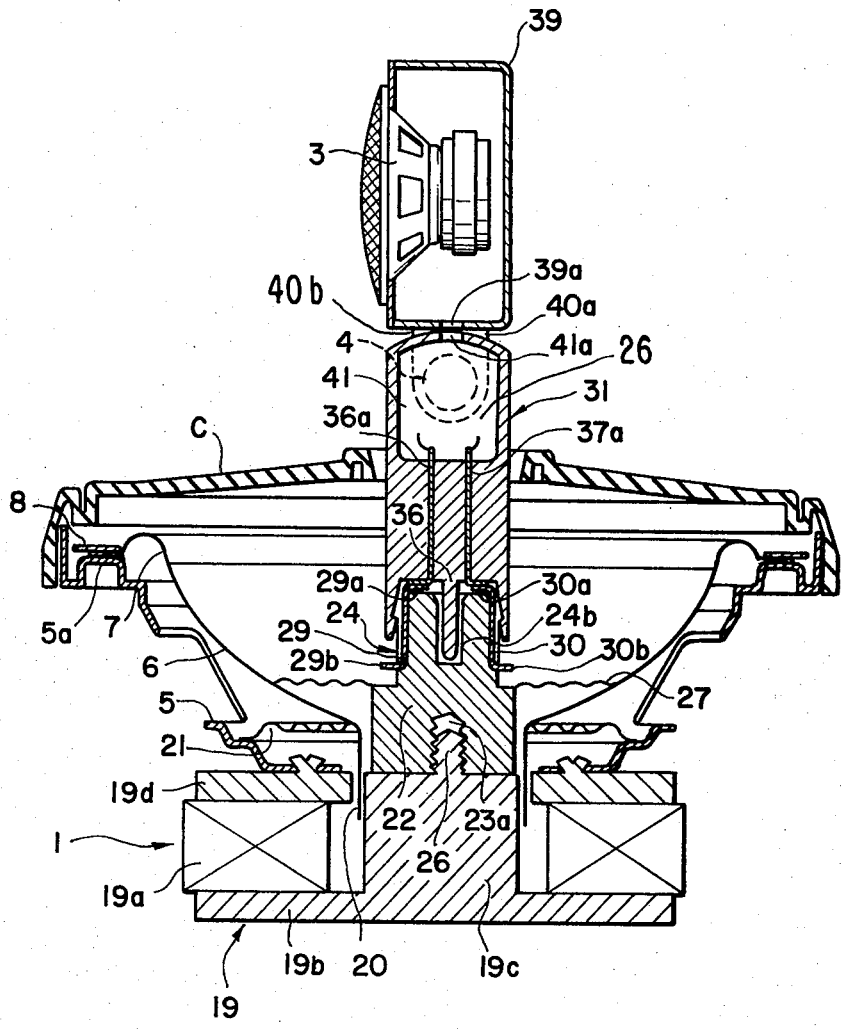
FIG. 5 is a cross-sectional view showing a modification of the first embodiment shown in FIG. 2.

A second embodiment of a speaker system of the invention will be described with reference to FIGS. 5 and 6 in which the speaker unit 3 is designed to be rotatable in the horizontal plane as well as in the vertical plane. FIG. 5 is a cross-sectional view showing the second embodiment of a composite speaker system according to the invention. In this figure, reference numeral 19 designates a magnetic circuit for the low-range speaker unit 1 which is made up of a magnet 19*a*, a yoke 19*b*, a pole 19*c* and a plate 19*d*. A central portion of the diaphragm 6 of the low-range speaker unit 1 is attached to a voice coil bobbin 20 which carries a voice coil (not shown). A first damper 21 is provided extending between the diaphragm 6 from slightly above the voice coil bobbin 20 and the frame 5. The edge portion 7 of the diaphragm 6 is fixed to the outer peripheral portion 5*a* of the frame 5 which is constructed as described with reference to FIG. 3.

Reference numeral 22 designates a first spacer made of insulating material. As shown in FIG. 6, the first spacer 22 is integrally formed with a larger-diameter cylindrical member 23 and a smaller-diameter cylindrical member 24 with the smaller-diameter member 24 disposed above the larger-diameter member 23. A female thread 23*a* is formed in the center of the bottom surface of the larger-diameter cylindrical member 23. The first spacer 22 is fixedly disposed above the center pole 19*c* by threaded engagement of a male thread 26, formed on and extending upwardly from the center pole 19*c*, and the female thread 23*a*. A second damper 27 is connected between a stepped portion 25 of the spacer 22 and the diaphragm 6 in the usual fashion. The smaller-diameter cylindrical member 24 has a tapered surface 28*a* at the upper portion thereof and a stepped lower surface 28*b* acting as a stop. A pair of conductive plates 29 and 30 extend through the body portion of the smaller-diameter cylindrical member 24, with first ends 29*b* and 30*b* projecting outwardly from the lower side portion of the cylindrical member 24 while the second ends 29*a* and 30*a* project from the top surface 24*a* of the cylindrical member 24 and are bent towards the center of the cylindrical member 24 confronting each other. The projecting and bent portions 29*a* and 30*a* of the conductive plates 29 and 30 provide a resilient force in the upward direction. The outwardly projecting portions of the conductive plates 29 and 30 act as terminals as will be described below. A guide hole 24*b* having a predetermined depth is formed at the center of the upper surface 24*a* of the smaller-diameter cylindrical member 24. An arc-shaped guide groove 24*c* (FIG. 6) is coaxially formed in the upper surface 24*a* of the cylindrical member 24.

Reference numeral 31 designates a second spacer made of insulating material rotatably engaged with the first spacer 22. The lower portion of the second spacer 31 is cylindrical. The inner wall of the cylindrical portion of the second spacer 31 is tapered so as to fittingly engage the tapered surface 28*a* of the smaller diameter cylindrical member 24. A stepped upper surface 42 is formed in the inner wall of the second spacer 31 with the stepped upper surface 42 abutting the stepped lower surface 28*b* formed in the first spacer 22 when the first and the second spacers 22, 31 are engaged. A guide pin 34*a* projects downwardly from the center of the lower surface 34*b* loosely engaging the aforementioned guide hole 24*b*. Arc-shaped contact pieces 36 and 37 are mounted separately on the surface 34*b* which contact the bent conductive plates 29*a* and 30*a*, respectively. A guide pin 38 is also provided in the surface 34*b* which is adapted to engage and slidably move along the guide groove 24*c* formed in the upper surface 24*a* of the first spacer 22.

Lead wires 36*a* and 37*a* (FIG. 5) connected to the contact pieces 36 and 37 pass through the interior of the second spacer 31 and exit from a chamber 26 above the second spacer 31. To the lower surface of the casing 39 (FIG. 6) which holds the medium- and high-range speaker unit 3, a pair of legs 40*a* and 40*b* are secured and are inserted into the chamber 26. These legs 40*a*, 40*b* are tightened by a tightening screw (not shown) rigidly coupled to the knob 4 so that the casing 39 is freely rotatable in the vertical direction about the tightening screw. The lead wires (not shown) which extend from the voice coil of the speaker unit 3 pass through an opening 39*a* in the lower surface of the casing 39 and an opening 41*a* in the upper surface of the chamber 41 and are connected to the lead wires 36*a* and 37*a*. The terminals 29*b* and 30*b* which project outwardly from the lower side portion of the smaller-diameter cylinder member 24 are connected in parallel with lead wires (not shown) connected to the woofer voice coil.

The mounting of the speaker unit 3 above the position of the speaker unit 1 will next be described. The second spacer 31 extends downwardly from the central opening of the grills C engaging the first spacer 22. The lower circumferential edge 31*a* of the second spacer 31 contacts the tapered surface 28*a* when the second spacer 31 is downwardly inserted. When the second spacer 31 is inserted downwardly, the diameter of the lower circumferential edge 31*a* is enlarged due to the forced contact with the tapered surface 28*a* of the first spacer 22. When the lower circumferential edge 31*a* is further inserted, the stepped lower surface 28*b* is brought into abutment with the stepped upper surface of the first spacer 22. Then, the diameter of the lower circumferential edge 31*a* is restored to the original size. In the abutted condition, the guide hole 24*b* formed in the upper surface 24*a* of the first spacer 22 receives the guide pin 34*a* provided in the second spacer 31. Further, the guide pin 38 is inserted into the guide groove 24*c* and is movable therealong. Consequently, the second spacer 31 is attached to the first spacer 22 but is freely rotatable. The second spacer 31 is not detached from the first spacer 22 due to the abutment of the stepped surfaces 28*a* and 28*b*. In this condition, the bent portions 29*a* and 30*a* of the metal plates 29 and 30, and the contact pieces 36 and 37 are electrically connected due to the upward resilient force of the bent portions 29*a* and 30*a*.

Figure 4:
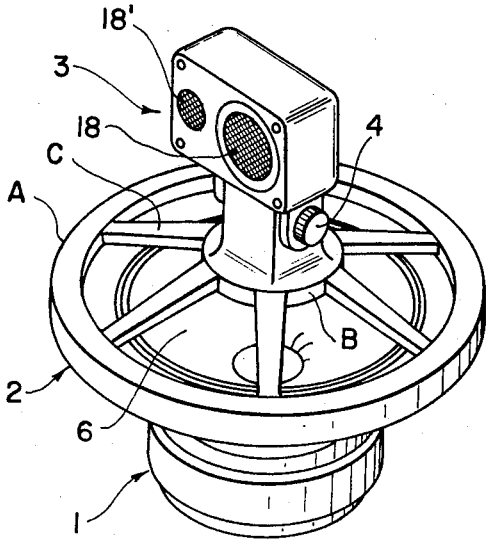
FIG. 4 is a perspective view showing a composite speaker system constructed according to a second embodiment of the invention.

FIG. 4 is a perspective view showing a speaker system according to another embodiment of the invention. This embodiment is similar to the embodiment shown in FIG. 2 with the exception that the speaker unit for the medium- and high-range sound is separated into individual units, specifically, a medium-range speaker 18 and a high-range speaker 18' positioned side-by-side in the casing. It is possible to modify this embodiment by arranging the high-range and medium-range speakers vertically.

With a composite speaker of the invention constructed as described above, sound emanating from the low-range speaker unit is reflected from the rear window and then radiated forwardly if the low-range speaker unit is flush mounted on the rear parcel shelf of the vehicle while the sound emanating from the medium- and high-range speaker unit is directly radiated forwardly. The radiating direction of the sound emanating from the medium- and high-range speaker can further be changed horizontally. Accordingly, the drawbacks accompanying the conventional speaker system are eliminated.

What is claimed is:

1. A speaker unit for automotive vehicles comprising:

a low-range speaker and a medium- and high-range speaker;

means for changing an angular orientation of a center axis of said medium- and high-range speaker in a vertical plane containing a center axis of said low-range speaker;

a grill frame and a grill member mounted in said grill frame, an open surface of said low-range speaker being at least partly covered with said grill member, said grill frame being detachably engaged with the open surface of said low-range speaker;

a first pair of terminals fixedly mounted upon an outer peripheral portion of a frame member of said low-range speaker;

a second pair of terminals rigidly secured to said grill frame, said first and second pairs of terminals being adapted to be connected together when said grill frame is engaged with the open surface of said low-range speaker, said first pair of terminals being coupled to a voice coil bobbin of said low-range speaker and said second pair of terminals being coupled to a voice coil bobbin of said medium- and high-range speaker.

2. The speaker unit of claim 1 wherein said medium- and high-range speaker is mounted upon said grill frame.

3. The speaker unit of claim 2 wherein said grill frame comprises an outer annular ring, a center hub portion and a plurality of spokes extending between said annular ring and said hub portion, said medium- and high-range speaker being coupled to said hub portion.

4. The speaker unit of claim 1 wherein each terminal of said first pair of terminals comprises an insulating tubular member extending through said frame member and an electrically conductive member extending at least partially into said tubular member.

5. The speaker unit of any one of claims 1–4 wherein said medium- and high-range speaker comprises a single speaker.

6. The speaker unit of any one of claims 1–4 wherein said medium- and high-range speaker comprises separate medium-range and high-range speakers.

7. The speaker unit of any one of claims 1–4 further comprising means for rotating said medium- and high-range speaker about a vertical axis at least through a predetermined angle.

8. A speaker unit for automotive vehicles comprising: a low-range speaker and a medium- and high-range speaker;

means for changing an angular orientation of a center axis of said medium- and high-range speaker in a vertical plane containing a center axis of said low-range speaker;

a grill frame and a grill member mounted in said grill frame, an open surface of said low-range speaker being at least partly covered with said grill member, said grill frame being detachably engaged with the open surface of said low-range speaker;

mounting means for said medium- and high-range speaker, said mounting means comprising a first spacer having a smaller-diameter portion and a larger-diamter portion, said larger-diameter portion being rigidly secured to a pole of a magnetic circuit of said low-range speaker and at least a portion of said larger-diameter portion being surrounded by a voice coil bobbin of said low-range speaker, a damper member having an outer edge coupled to a diaphragm of said low-range speaker and having an inner edge coupled to said larger-diameter portion at the junction with said smaller-diameter portion, said smaller-diameter portion having an upper tapered surface, first and second conductors extending through portions of said smaller-diameter portion and forming contacts upon said upper surface;

a second spacer having a lower cylindrical portion tapered to fittingly engage said upper surface of said first spacer, third and fourth conductors extending through a portion of said second spacer and forming contacts disposed to mate with said contacts formed by said first and second conductors;

and means for tiltably mounting said medium- and high-range speaker upon an upper portion of said second spacer, a voice coil bobbin of said medium- and high-range speaker being coupled to said third and fourth conductors.

9. The speaker unit of claim 8 wherein said second spacer has a first guide pin extending downwardly from the center thereof to mate with a guide hole formed in said first spacer.

10. The speaker unit of claim 9 further comprising a second guide pin rigidly coupled at an off-center position to said second spacer and being slidably disposed in an arc-shaped guide groove coaxially formed in said upper surface of said first spacer.

* * * * *